US006209765B1

(12) United States Patent
King

(10) Patent No.: US 6,209,765 B1
(45) Date of Patent: Apr. 3, 2001

(54) COIN HOLDING ACCESSORY

(76) Inventor: Patricia Ann King, 1726 N. Daffodil St., Tempe, AZ (US) 85281

( * ) Notice: Subject to any disclaimer, the term of this patent is extended or adjusted under 35 U.S.C. 154(b) by 0 days.

(21) Appl. No.: 09/363,399

(22) Filed: Jul. 29, 1999

(51) Int. Cl.[7] ..... A45F 3/18

(52) U.S. Cl. ..... 224/250; 224/148.6; 224/679; 224/901

(58) Field of Search ..... 224/148.6, 221, 224/222, 226, 250–660, 901.8, 901, 148.4, 148.5, 674, 679

(56) References Cited

U.S. PATENT DOCUMENTS

| | | | | |
|---|---|---|---|---|
| D. 374,325 | * | 10/1996 | Merrill et al. | D2/627 |
| D. 432,785 | * | 10/2000 | Berg et al. | D3/229 |
| 869,310 | * | 10/1907 | Lemly | 224/674 X |
| 4,974,761 | * | 12/1990 | Luque | 224/148.6 |
| 5,158,220 | * | 10/1992 | Glass | 224/657 |
| 5,169,043 | * | 12/1992 | Catania | 224/660 |
| 5,240,158 | * | 8/1993 | Walsh | 224/226 |
| 5,385,281 | * | 1/1995 | Byrd | 224/148 |
| 5,431,319 | * | 7/1995 | Cavadini et al. | 224/258 |
| 5,582,337 | * | 12/1996 | McPherson et al. | 224/660 |
| 5,642,842 | * | 7/1997 | Taras | 224/250 |
| 5,730,339 | * | 3/1998 | Stolfo | 224/148.6 |
| 5,836,497 | * | 11/1998 | Pelish | 224/677 |
| 5,864,289 | * | 1/1999 | Tiemann | 340/568.7 |
| 6,050,119 | * | 4/2000 | Potts | 70/456 R |

* cited by examiner

*Primary Examiner*—Allan N. Shoap
*Assistant Examiner*—Joe Merek
(74) *Attorney, Agent, or Firm*—Richard R. Mybeck

(57) ABSTRACT

A coin-holder accessory for use at casinos and like establishments comprising an adjustable belt adapted to circumscribe the user's waist and be lockable in place thereabout and having a strip portion secured thereto. The strip portion has a obverse surface bearing a layer of pressure sensitive adhesive having a detachable protective sheet disposed thereacross and which, when removed, exposes the adhesive layer and enables the strip to be bonded to a coin-cup holder adjacent the upper lip thereof. The cup thus mounted to the belt and the belt customized to the user's waist and buckled enables the wearer to support many coins in the cup which is maintained in a vertical position adjacent wearer's abdomen to prevent spillege while enabling the wearer to vigilantly protect the contents of the cup.

8 Claims, 1 Drawing Sheet

COIN HOLDING ACCESSORY

The present invention relates to a coin holding accessory and more particularly to a accessory comprising an adjustable belt having means associated therewith for customizing the length of the belt, means for securing a coin cup thereto to secure the cup and the contents thereof securely to the belt, and means for fastening the belt securely about the user's waist. The accessory is especially useful for one who plays casino slot machines and will be disclosed in that context.

BACKGROUND OF THE INVENTION

Gambling establishments customarily supply coin cups for their patrons to use to hold coins which are played in slot machines. Typically, a user will take a coin cup and fill it with a number of coins and then use those coins to play the slot machines. This coin cup allows the user to carry the coins around in a convenient manner. Also, when the patron of the gambling establishment wins at the slot machine, the slot machine will expel numerous coins, the quantity of which depends on the particular win. These numerous coins are then gathered up and placed in the coin cup by the winning patron and either spent again at the slot machine or other gambling tables, or kept by the patron as his winnings. In any case, the coin cup has become the means by which patrons of gambling institutions carry around their coins.

However, even though the coin cup makes it easier to carry around coins as compared with, for example, having to carry the coins in one's hand or one's pockets, the coin cup still has many inadequacies. For example, the coins carried in the coin cup become a heavy burden when carried by the user for a prolonged period of time. Also, because the coin cups of various individuals are identical, there is always the danger that one will set down his cup next to another individual's and unintentionally pick up the wrong cup. Furthermore, patrons carrying around coin cups may be subject to pilfering by unscrupulous individuals at the gambling establishment who intentionally pick up the wrong cup when the cup is set down while the player rests his arms or is preoccupied with spinning symbols. In any event, absolute control of the contents of a discrete portable cup is iffy at best.

In addition, gambling establishments often wish to promote their establishment using, for example, inexpensive items which may be used by the patrons of the gambling establishment while at the establishment and later kept as a memento or thrown away. It is therefore desirous that such items have some imprinting on them which affiliates the item with the particular gambling establishment or has some other promotional reason. Such gambling establishments also give away such items to their patrons, in which case the cost associated with each item is of particular importance and must be kept to a reasonable minimum. Additionally, such an item should have some useful purpose pertaining to the gambling experience and ideally will have a positive effect on the patron by, for example, reducing the fatigue associated with performing the gambling activity. The coin holder accesory of the present invention is ideal for meeting those goals.

There have been attempts in the past to provide a means for reducing the fatigue associated with transporting the coin cup by patrons at a gambling establishment. For example, U.S. Pat. No. 4,978,761, issued to Luque, discloses a slot bag gambling accessory comprising a closeable pouch which is used to transport a coin cup. However, among the many inadequacies of this prior attempt is the relatively complicated structure of the device which increases the cost and difficulty in manufacturing the device. Also, this prior attempt, which discloses a closable pouch to fully enclose the coin cup fails to provide an easily manufactured product which the gambling establishment can afford to give away to its patrons, while still providing a device which has utility when used by the patrons while performing a gambling activity at the gambling establishment. Thus, there is a need to provide an apparatus which is inexpensive to manufacture, is durable, provides the utility of supporting a coin cup used by the patron at the gambling establishment and, above all, places the coins in a readily observable and controllable location at all times during its use.

In an attempt to solve some of the problems remaining after the Luque device, Cavadini et al. in U.S. Pat. No. 5,431,319 taught a method of holding a slot machine coin cup involving a closed-circle loop strap dimensioned to circumscribe a tapered coin-cup inserted therethrough and strap means stitched to the loop at diametrically opposite points of the perimeter thereof and extending perpendicularly therefrom for suspending the cup from the player's neck or shoulders.

This teaching suffered from the fact that while the hopefully coin-filled cup was supported by the player, it was not secured to the player and as a result was subject to swaying and spilling during the player's movement. Furthermore, the cup could be readily stolen from the player while she/he was diverted by favorable images on the screen being played. The device was also extremely awkward and uncomfortable when used by women of exceptionally full bosom and left much to be desired.

Accordingly, a number of problems of coin storage and transport still remain and it is toward the resolution of these problems that the present invention is directed.

BRIEF SUMMARY OF THE INVENTION

The present invention is intended to overcome the drawbacks of the prior art and to provide a holder for a coin cup which is inexpensive and easy to manufacture, is readily transportable and provides enhanced security for the player's cache. The present invention has been developed to provide a coin cup holder which is constructed from durable, strong, and inexpensive material and which enables a participant at a gambling establishment to easily and securely carry around coins in the coin cup.

In accordance with the present invention, an adjustable strap member is provided with a secure interlocking buckle means having, adjacent to the buckle means a fabric strip portion secured to the outer surface thereof upon which a pressure sensitive adhesive is placed having a removable protective cover disposed thereupon. The strip portion is provided with a length substantially equal to the circumference of a standard coin cup (circa 4.5 inch mouth diameter) beneath the upper lip thereof (about ½ inch down). The protective cover is removed from the adhesive layer and the layer is firmly pressed to the cup for bonding therewith and to provide a complete collar around the cup adjacent the upper lip thereof The buckle is then unfastened, the belt is wrapped about the waist of the player, adjusted for size by sliding adjustment means to shorten or lengthen the belt to the wearer's dimension, the buckle portions are locked together and the cup is then securely fastened to the player in a vertical position for use as a readily observable token/coin receptacle during the player's adventures at the casino.

Accordingly, the primary object of the present invention is to provide a coin holding accessory which is inexpensive to manufacture, easy to mount, stable in use, and totally within the control and protection of its owner throughout its use.

Another object of the present invention is to provide attachment means readily adaptable to the diverse coin cups currently disposed by the many casinos to secure coin cup to a belt circumscribing the wearers waist.

A still further object of the present invention is to provide a stable readily observable cup-belt assembly for wear by casino players to store the plurality of coins accumulated during the player's visit to the casino.

These and still further objects as shall hereinafter appear are readily fulfilled by the present invention as will be discerned from a careful reading of the following description, particularly when read in conjunction with the accompanying drawing in which the like portions bear like numerals throughout the several views.

DESCRIPTION OF THE PREFERRED EMBODIMENT

Figure 1:
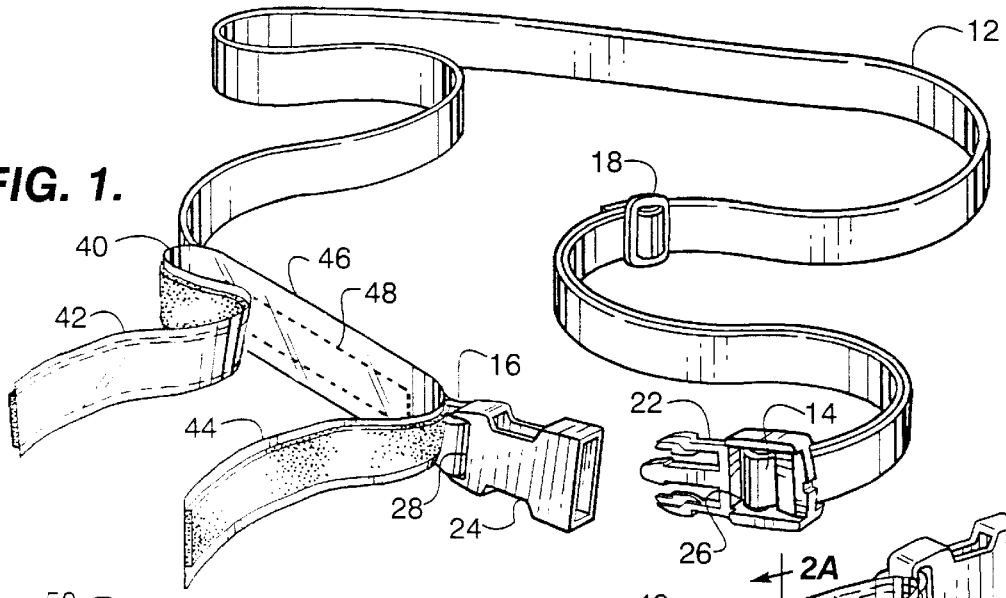
FIG. 1 is an isometric view of an expandable, latchable belt having an adhesive strip attached thereto in accordance with the present invention.

For purposes of promoting an understanding of the principles of the invention, reference will now be made to the embodiments illustrated in the drawings and specific language will be used to describe the same. It will nevertheless be understood that no limitation of the scope of the invention is thereby intended, there being contemplated such alterations and modifications of the illustrated device, and such further applications of the principles of the invention as disclosed herein, as would normally occur to one skilled in the art to which the invention pertains.

Referring to FIGS. 1–4, an isometric view of the new and improved coin holding gambling accessory of the present invention is shown. The gambling accessory ("device") 10 comprises an elongated belt member 12 having a first end 14 and second end 16 and length adjustment means 18 operatively interposed therebetween. A buckle means 20 is attached to belt 12 so that male buckle portion 22 is secured to the first end 14 of belt 12 and female buckle portion 24 is secured to second end 16 of belt 12, each being laced to its associated end by reeving a short portion of belt 12 through slot means 26, 28, respectively, provided in buckle portions 22, 24.

Suitable adjustment means 18 are mounted on belt 12, intermediate ends 14 and 16 to readily adjust the overall length of belt 12 by sliding along the length of belt 12 to conform the length of belt 12 to the wearer's waist circumference and assure a snug but comfortable fit.

A suitable coin cup 30 having an upper lip 32 and a body portion 34 is provided which usually, but not essentially, has a downwardly tapered profile and is usually provided by the establishment being visited by the player.

Figure 2A:
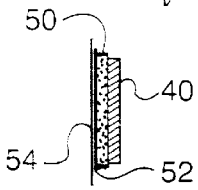
FIG. 2A is a cross-sectional view taken on line A—A of FIG. 2.
Figure 2:
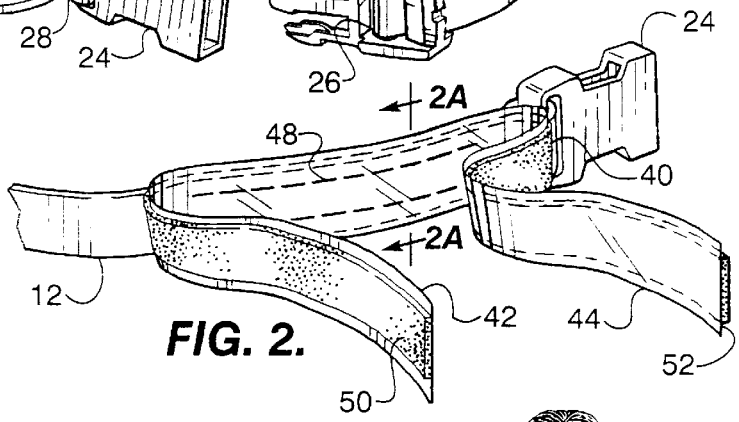
FIG. 2 is an enlarged fragment of the obverse side of the belt of FIG. 1 where the adhesive strip is attached thereto.
Figure 3:
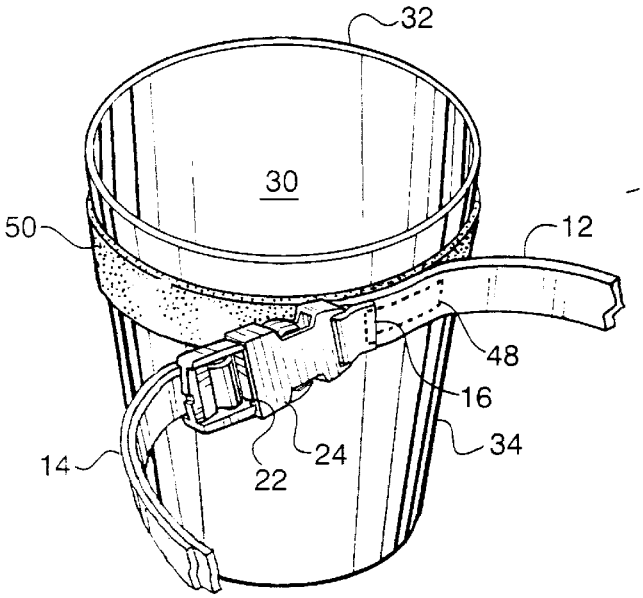
FIG. 3 is an isometric view, partially fragmented, of a casino coin cup having the belt cemented in operative position relative thereto.

Reverting to the belt 12, as shown in FIGS. 1 and 2, an elongated strap member 40 is shown having a first end portion 42, a second end portion 44, and an intermediate portion 46. The strap 40 is attached to belt 12 in any suitable fashion such as by stitching 48 intermediate portion 46 to belt 12 adjacent one of the buckle portions, for example, portion 24. The surface 50 of strap 40, remote from belt 12, is impregated with a layer 52 of suitable adhesive such as, rubber cement, or acrylic cement or the like and covered with a detachable protective sheet 54 formed of a suitable material such as polypropylene and the like which will be removable to completely expose adhesive layer 52 when it is desired to secure strap 40, and hence belt 12, to the cup 30, preferably after the length of belt 12 has been customized to the wearer's waist.

Figure 4:
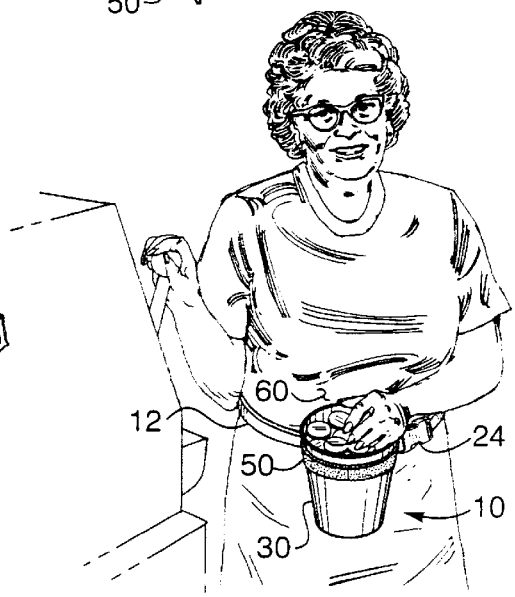
FIG. 4 is an isometric view of the gambling accessory of the present invention when fully assembled and mounted for use by a casino patron.

Once protective sheet 54 has been removed, the exposed adhesive layer 52 on intermediate portion 46 of strap 40 is firmly pressed onto and engaged with cup 10 adjacent and parallel to cup lip 32 and firmly pressed into adherent contact with cup 10. Next, one of the end portions, for example, portion 42 is firmly pressed against and around one portion of cup 10 in the same relative position, that is, adjacent and parallel to lip 32 and, finally, the other end portion, for example, portion 44, is likewise pressed against and around another portion of cup 10 to securely attach belt 12 to cup 10. The device is now ready to be worn and is secured to the player by wrapping the belt 12 around the player's waist with cup 10 extending outwardly from belt 12 adjacent the wearer's abdomen 60. Buckle portion 22 is then inserted into buckle portion 24 and the belt 12 is locked in place as shown in FIG. 4.

Thus mounted, gambling accessory 10 is ready for use and provides visible, secure, stable and comfortable means for storing and transporting whatever and as many coins as fate decrees the wearer to obtain. The accessory is generally worn to the true front by a standing patron although it can easily be shifted off-center to facilitate sitting by a tired or disabled player.

From the foregoing, it is apparent that a new and useful gambling accessory has been herein described and illustrated which fulfills all of the foregoing objectives in a remarkably unexpected fashion. It is of course understood, that such alterations and adaptations as may readily discerned from the foregoing disclosure by one having the ordinary skill in the art to which this invention pertains are intended within the present disclosure which is limited solely by the scope of the claims attached hereto.

Accordingly, what is claimed is:

1. A coin-holding accessory comprising a belt member, a coin holder, means for attaching said coin holder to said belt member on the perimeter thereof, and means for securing and maintaining said coin holder in vertical, fully-visible position;

said belt member comprises an elongated body portion having a first end and a second end at the proximal and distal ends thereof and adjustment means operatively interposed therebetween to selectively vary the distance between said proximal and said distal end of said belt member; having a strip member attached to said belt member adjacent one of said ends of thereof, said strip member having a first and a second planar surface, said first planar surface being engaged in surface-to-surface engagement with the exterior surface of said belt member when said belt member is in its worn position; a layer of pressure sensitive adhesive spread over said second planar surface of said strip member; and a detachable protective sheet overlaying said layer of pressure sensitive adhesive.

2. A coin-holding accessory according to claim 1 comprising a male buckle means and a female buckle means operative to secure said belt member about the waist of a wearer, one of said buckle means being secured to said proximal end of said belt member and the other of said buckle means being secured to said distal end of said belt member.

3. A coin-holding accessory according to claim 1 comprising a male buckle means and a female buckle means operative to secure said belt member about the waist of the wearer one of said buckle means being secured to said proximal end of said belt member and the other of said buckle means being secured to said distal end of said belt member.

4. A coin-holding accessory according to claim 1, in which said detachable protective sheet is removed and said coin holder is engaged by said pressure sensitive adhesive in a vertical fully visible position when said belt is about the waist of wearer.

5. A coin-holding accessory for use by casino patrons comprising a belt member and means secured to said belt member adapted to secure a coin cup to said belt member in a secure, vertical, fully visible position relative to said patron;

said belt member comprises an elongated body portion having a first end and a second end at the proximal and distal ends of thereof and adjustment means operatively interposed therebetween to selectively vary the distance between said proximal and said distal end of said belt member; having a strip member attached to said belt member adjacent one of said ends thereof, said strip member having a first and a second planar surface, the first planar surface being engaged in surface-to-surface engagement with the exterior surface of said belt member when said belt member is in its worn position; a layer of pressure sensitive adhesive spread over the second planar surface of said strip member; and a detachable protective sheet overlaying said layer of pressure sensitive adhesive.

6. A coin-holding accessory according to claim 5 comprising a male buckle means and a female buckle means operative to secure said belt member about the waist of 1 wearer, one of said buckle means being secured to said proximal end of said belt member and the other of said buckle means being secured to said distal end of said belt member.

7. A coin-holding accessory according to claim 5 comprising a male buckle means and a female buckle means operative to secure said belt member about the waist of the wearer one of said buckle means being secured to said proximal end of said belt member and the other of said buckle means being secured to said distal end of said belt member.

8. A coin-holding accessory according to claim 5, in which said detachable protective sheet is removed and said coin holder is engaged by said pressure sensitive adhesive in a vertical fully visible position when said belt is about the waist of a wearer.

* * * * *